United States Patent [19]

Boudouris et al.

[11] 4,293,821

[45] Oct. 6, 1981

[54] AUDIO CHANNEL SEPARATING APPARATUS

[75] Inventors: Angelo Boudouris, Sylvania, Ohio; Edwin F. Peters, Lambertville, Mich.

[73] Assignee: Eprad Incorporated, Toledo, Ohio

[21] Appl. No.: 48,840

[22] Filed: Jun. 15, 1979

[51] Int. Cl.[3] ..... H04R 5/00

[52] U.S. Cl. ..... 330/126; 179/1 G

[58] Field of Search ..... 330/126; 179/1 G

[56] References Cited

U.S. PATENT DOCUMENTS 3,184,550 5/1965 Rogers ..... 330/126

4,024,344 5/1977 Dolby et al. ..... 179/1 G

*Primary Examiner*—Alfred E. Smith

*Assistant Examiner*—T. N. Grigsby

*Attorney, Agent, or Firm*—Oliver E. Todd, Jr.

[57] ABSTRACT

Apparatus is disclosed for separating two audio signals on two input channels and combining them to provide three output signals on three output channels in which the separation is based on comparisons of the average absolute values of the highest amplitudes of the signals on the input channels with the average absolute value of the difference between the signals on the input channels.

3 Claims, 2 Drawing Figures

AUDIO CHANNEL SEPARATING APPARATUS

BACKGROUND OF THE INVENTION

This invention relates to sound systems and more particularly to apparatus for separating two audio signals appearing on two separate input channels into output signals appearing on at least three output channels. The apparatus is particularly useful for separating the audio signals recorded on two tracks of motion picture film into three or more separate channels for a theatre sound system.

Under today's standards, most commercial motion picture film is provided with two sound tracks on which are recorded two separate audio signals for producing a stereophonic sound effect. In the production of many films, the producer and director of the picture would like to create sounds and sound effects which heretofore have not been possible on a two channel sound system. For example, in addition to the normal left and right channels which provide directional sound effects, it is sometimes desirable to surround the theatre patrons with sound and special sound effects. Also, it often is desirable to provide a third or center channel in addition to the normal left and right channels. The center channel is desirable, for example, during normal speech when the sound is effectively monaural. In the past, a center channel sometimes has been produced simply by combining the audio signals appearing on the left and right channels. Signals are applied to the center channel simultaneously with the left and right channels. This has not been completely satisfactory since it reduces the directional effect of the sound when all three channels are operating.

SUMMARY OF THE INVENTION

According to the present invention, apparatus is provided for separating two audio signals of varying amplitudes appearing on two input channels into output signals appearing on at least three output channels. When the input channels are separated into three output channels, one serves as a left channel, a second serves as a right channel and a third serves as a center channel. When the input signals are separated into four output channels, the fourth channel may be used for special sound effects, such as for surrounding the listener with sound, while silencing the left, right and center output channels. The two input channels, which hereinafter will be referred to as left and right input channels, are amplified and connected directly to left and right output channels, respectively. In addition, the signals appearing on the left and right input channels are summed, amplified and applied to the third or center output channel. When the input signals appearing on the left and right channels are of substantially equal amplitude and similar in characteristics, the signals applied to the left and right output channels are attenuated so that substantially all of the sound will emanate from the center channel. When the signal appearing on one of the left or the right input channels is greater in amplitude than the signal appearing on the other channel, the signal applied to the center output channel is attenuated so that the sound will emanate from the left and right channels to provide a directional effect. The signal applied to the center channel also is attenuated when the signals on the left and right input channels are equal in magnitude but different in characteristics, such as may occur with recorded music where different instruments are prominent on the two input channels. When a fourth channel is desired, a signal is applied to the fourth channel when the amplitude of the signals appearing on the left and right input channels are substantially equal and 180° out of phase. At this time, the signals appearing on the left and right output channels are attenuated because the input signals are equal in amplitude and no signal will appear on the center channel since the sum of the equal amplitude out of phase input signals is zero. Through apparatus of this type, the film director and the producer and sound directors have considerable freedom in providing special sound effects and/or special control information on motion picture film having only two sound channels. The apparatus also is adaptable to the home high-fidelity market for use with stereophonic recordings which have been re-recorded into quadraphonic sound.

Accordingly, it is an object of the present invention for providing improved apparatus for separating two audio signals appearing on two input channels into at least three audio signals appearing on separate output channels.

Another object of the invention is to provide apparatus for use in a motion picture theatre sound system capable of separating two recorded sound tracks on motion picture film into at least three separate sound channels.

Other objects and advantages of the invention will become apparent from the following detailed description, with reference being made to the accompanying drawings.

BRIEF DESCRIPTION OF THE DRAWINGS

The single figure composed of FIG. 1A and FIG. 1B, is a schematic circuit diagram of apparatus in accordance with the present invention for separating two audio signals of varying amplitudes appearing on two input channels into output audio signals on at least three output channels.

DESCRIPTION OF THE PREFERRED EMBODIMENTS

Figure 1A:
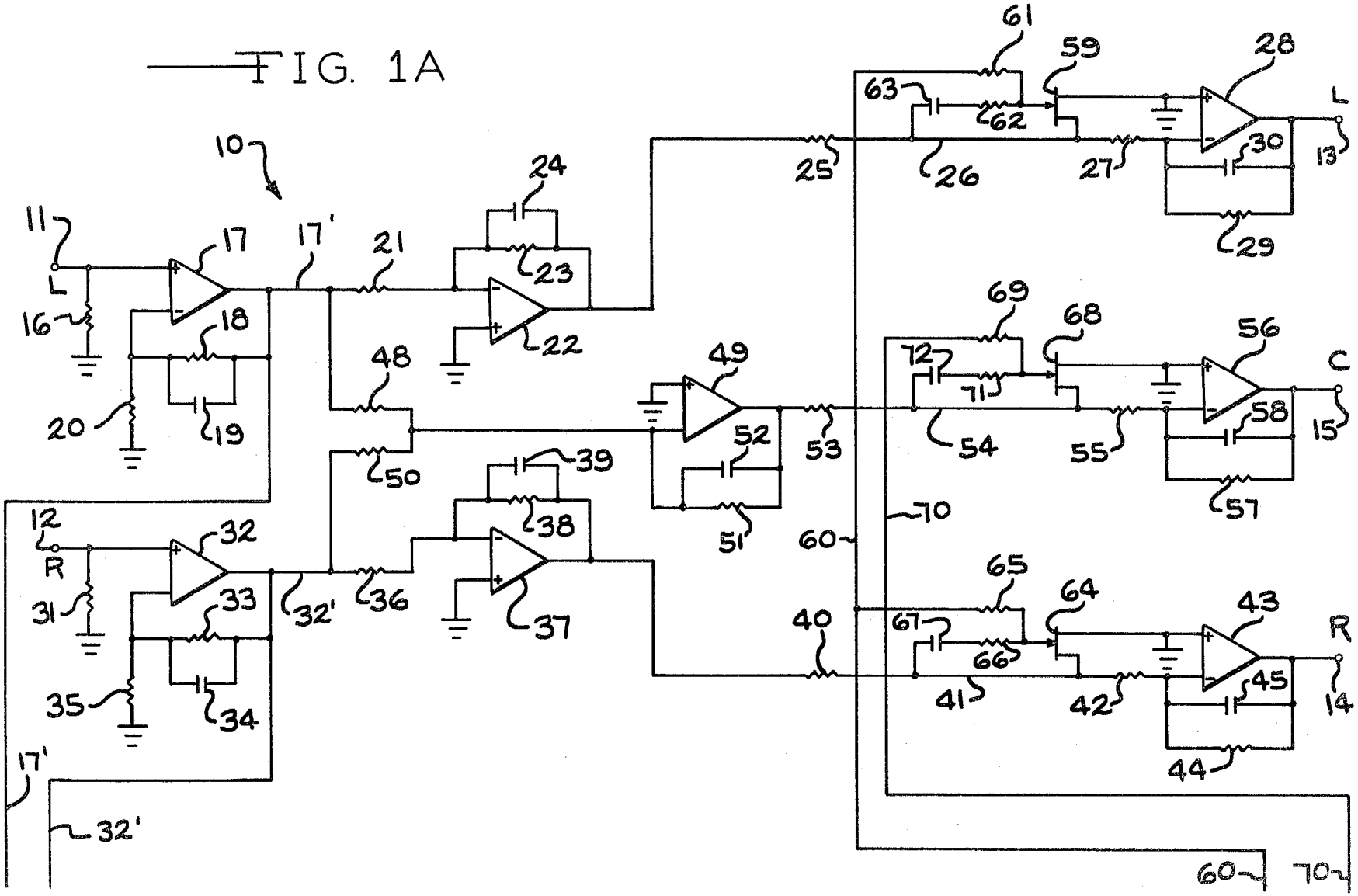
Figure 1B:
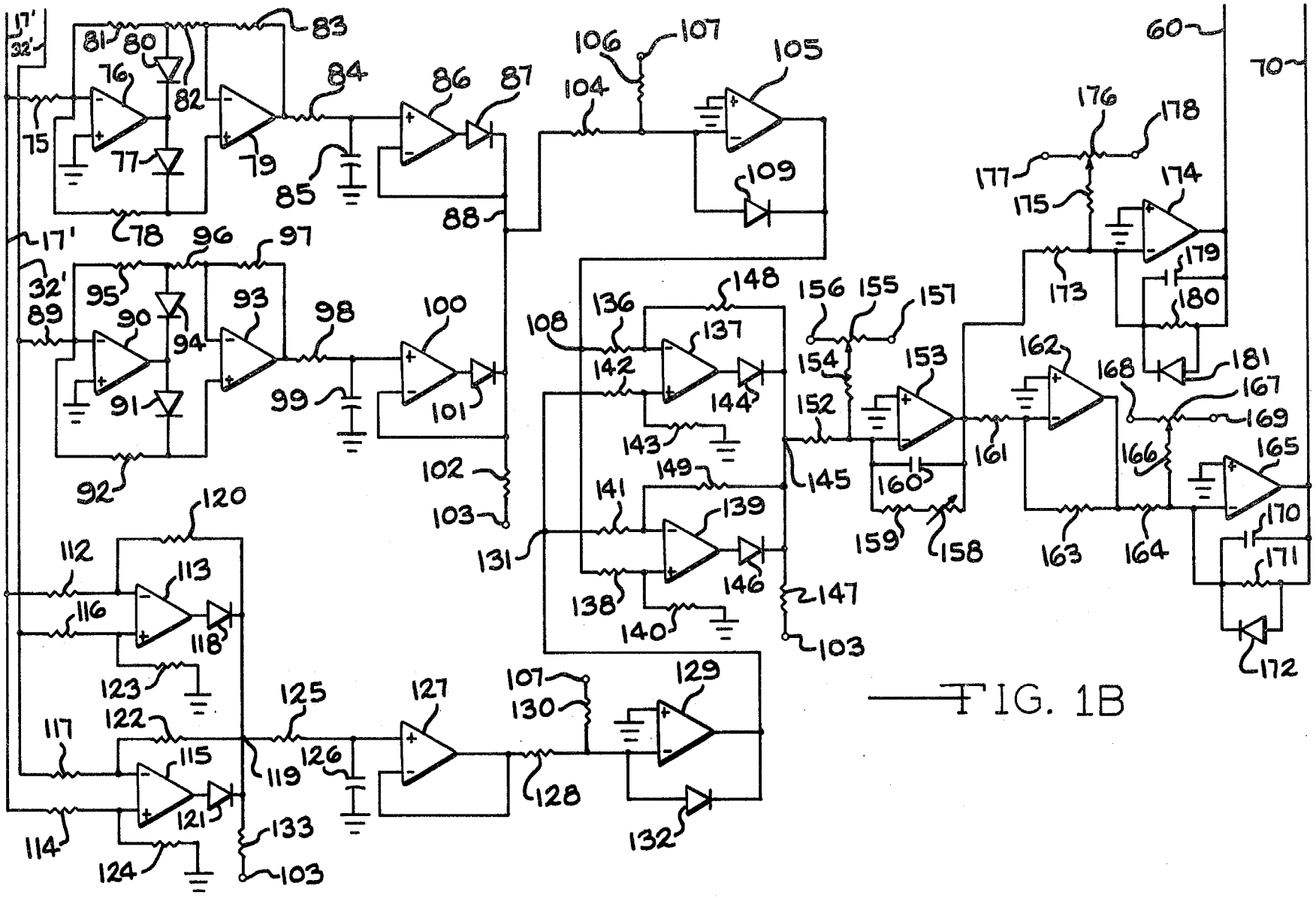

Turning now to the drawing, a schematic circuit diagram is presented for apparatus 10 in accordance with the present invention for separating two audio signals appearing on left and right input channels 11 and 12, respectively, into output signals appearing on at least a left output channel 13, a right output channel 14 and a center output channel 15. A fourth output channel (not shown) may be provided for special sound effects such as for surrounding patrons in a motion picture theatre with sound. During normal stereophonic operation, the signal appearing on the left input channel 11 is applied to the left output channel 13, the signal appearing on the right input channel 12 is applied to the right output channel 14 and the center output channel 15 is silent. During monophonic operation, the sum of the signals applied to the left and the right input channels 11 and 12 is applied to the center output channel 15 and the left and right output channels 13 and 14 are silent. Networks are provided for selectively attenuating signals to the three outputs 13, 14 and 15. If signals on the left input channel 11 are greater than the signals on the right input channel 12 or if the signals on the right input channel 12 are greater than signals on the left input channel 11, then signals to the center output channel 15 are attenuated. The signals to the center output channel 15 also are attenuated when the input signals on the channels 11 and 12 are substantially equal in amplitude but different in other characteristics such as frequency. Finally, if the signals on the left and right input channels 11 and 12 are substantially the same in amplitude and in frequency, then signals to the left and right output channels 13 and 14 are attenuated. If the signals on the left and right input channels 11 and 12 are equal in magnitude but 180° out of phase with respect to each other, then all three output channels 13, 14 and 15 will be silent since the signals to the left and right output channels 13 and 14 will be attenuated and the sum of the 180° out of phase input signals applied to the center channel 15 is zero.

The left input channel 11 is connected through a resistor 16 to ground and also to the noninverting input of an operational amplifier 17. The amplifier 17 is provided with a negative feedback resistor 18 and a parallel filter capacitor 19 connected from its output 17′ to its inverting input. The inverting input also is connected through a resistor 20 to ground. The amplifier output 17′ is applied through a resistor 21 to the inverting input of a second operational amplifier 22 which is provided with a negative feedback resistor 23 and a parallel filter capacitor 24. The output of the amplifier 22 is connected through a resistor 25 to a junction 26 and thence through a resistor 27 to the inverting input of a third operational amplifier 28. The amplifier 28 is provided with a negative feedback resistor 29 and a parallel filter capacitor 30. The output of the amplifier 28 is applied directly to the left output channel 13. Accordingly, an audio signal applied to the left input channel 11 normally passes through the three amplifiers 17, 22 and 28 to the left output channel 13.

The signal applied to the right input channel 12 is treated in a manner similar to the signal applied to the left input channel 11. The right input channel 12 is connected through a resistor 31 to ground and also to the noninverting input of an operational amplifier 32. A negative feedback resistor 33 and a parallel filter capacitor 34 are connected between the output 32′ and inverting input of the amplifier 32 and, also, a resistor 35 is connected from the inverting input to the ground. The amplifier output 32′ is applied through a resistor 36 to the inverting input of an operational amplifier 37. The amplifier 37 is provided with a negative feedback resistor 38 and a parallel filter capacitor 39 between its output and its inverting input. The output of the amplifier 37 is applied through a resistor 40 to a junction 41 and thence through a resistor 42 to the inverting input of an operational amplifier 43. The amplifier 43 is provided with a negative feedback resistor 44 and a parallel filter capacitor 45. The output of the amplifier 43 is applied directly to the right output channel 14. Accordingly, signals applied to the right input channel 12 normally pass through the three amplifiers 32, 37 and 43 to the right output channel 14.

The center output channel 15 carries a signal which is the sum of the signals appearing on the left and right input channels 11 and 12. The left channel audio signal appearing at the output 17′ of the operational amplifier 17 is applied through a resistor 48 to the inverting input of an operational amplifier 49. Similarly, the audio signal on the right channel taken at the output 32′ of the operational amplifier 32 is applied through a resistor 50 to the inverting input of the amplifier 49. Therefore, the amplifier 49 has an output which corresponds to the sum of the signals at the left and right channel inputs 11 and 12. The amplifier 49 is provided with a negative feedback resistor 51 and a parallel filter capacitor 52. The output of amplifier 49 is applied through a resistor 53 to a junction 54 and thence through a resistor 55 to the inverting input of an operational amplifier 56. A negative feedback resistor 57 and a parallel filter capacitor 58 are connected between the output and the inverting input of the amplifier 56. The output from the amplifier 56 is applied directly to the center channel output 15. Thus, a signal corresponding to the sum of the signals appearing on the left and right input channels 11 and 12, as taken at the amplifier outputs 17′ and 32′, respectively, normally is applied through the amplifiers 49 and 56 to the center output channel 15.

Field effect transistors (FET's) are provided for selectively attenuating signals in the left, right and center channels. In the left channel, an FET 59 is connected from ground to the junction 26 for selectively attenuating audio signals applied from the output of the amplifier 22 to the input of the amplifier 28. A junction 60 is connected through a resistor 61 to the gate electrode of the FET 59. The gate electrode of the FET 59 also is connected through a filter formed by a series resistor 62 and capacitor 63 to the junction 26. In the right channel, an FET 64 is connected between the junction 41 and ground for selectively attenuating audio signals applied from the output of the amplifier stage 37 to the input of the amplifier stage 43. The gate electrode of the FET 64 is connected through a resistor 65 to the junction 60 and also is connected through a filter formed by a series resistor 66 and capacitor 67 to the junction 41. As a consequence, the left and right channels are attenuated equally when a low negative voltage is applied to the junction 60. As the magnitude of a negative voltage on the junction 60 increases, the degree of attenuation decreases until the voltage on the junction 60 goes to the negative FET pinch-off voltage, at which point there is no attenuation in the left and right channels.

In the center channel, an FET 68 is connected from the junction 54 to ground for selectively attenuating audio signals applied from the output of the amplifier 49 to the input of the amplifier 56. The gate electrode of the FET 68 is connected through a resistor 69 to a junction 70 and also is connected through a filter formed by a series resistor 71 and capacitor 72 to the junction 54. The attenuation in the center channel is controlled in accordance with the voltage on the junction 70. When the junction 70 is less negative, the signal applied to the input of the amplifier 56 is attenuated. As the voltage on the junction 70 increases from less negative to more negative, the degree of attenuation is decreased until the signal goes to the negative FET pinch off voltage, at which time there is no attenuation in the center channel.

The different possible input and output arrangements for the apparatus 10 are illustrated in the following Truth Table. In this table, a zero is used to indicate an input signal of zero amplitude and to indicate when an output is fully attenuated. A 1 is used to indicate when an input signal is at its maximum level and also when an output signal is at its maximum unattenuated level. A 1′ indicates that the output signal for that channel is unattenuated, but, since there is no input signal for the channel, no output signal will exist for the channel.

Truth Table

| Case | Inputs L | Inputs R | \|L-R\| | \| (\|L\| or \|R\|) - \|L-R\| \| | Outputs L | Outputs C | Outputs R |
|---|---|---|---|---|---|---|---|
| A | 1 | 1 | 0 | 1 | 0 | 1 | 0 |
| B | 1 | 0 | 1 | 0 | 1 | 0 | 1' |
| C | 0 | 1 | 1 | 0 | 1' | 0 | 1 |
| D | 1 | 1 | 1 | 0 | 1 | 0 | 1 |
| E | 1 | 1 | 2 | 1 | 0 | 1' | 0 |

Case A in the above Truth Table illustrates the situation where a monaural signal is applied simultaneously to both the left and right input channels 11 and 12. In this situation, the input signals are summed and applied to the center output channel 15 while signals to the left and right output channels 13 and 14 are attenuated. In Case B, a signal appears on only the left input 11 and in Case C a signal appears only on the right input 12. In both of these cases, signals to the center channel 15 are attenuated. Signals are applied unattenuated to the left and right output channels 13 and 14. However, the output signals will only appear on the channel having an input signal. Case D illustrates a situation wherein signals of equal amplitude and different characteristics are applied simultaneously to the left and right input channels 11 and 12. This situation could arise, for example, during a stereophonic music passage where different instruments are predominant on the left and right channels but the amplitudes of the signals on the two channels happen to coincide. In this situation, we look at a signal corresponding to the difference between the absolute value of the largest average signal on the left and right channels, which signals happen to be identical, and the absolute value of the difference between the signals on the left and right channels. The result will equal zero since the average over a period of time of the absolute value of the difference between the signals on the left and right channels will equal the average value of the greatest of the signals on these channels. As a consequence, signals to the center channel 15 will be attenuated and there will be no attenuation on signals to the left and right output channels 13 and 14. Finally, in Case E the signals on the left and right input channels 11 and 12 are equal in magnitude and exactly 180° out of phase. In this case, signals applied to the left and right output channels 13 and 14 are completely attenuated. Although there is no attenuation in the center channel, there will be no output appearing on the center channel 15 since the sum of the out of phase and equal magnitude signals is zero. Therefore, all three output channels 13, 14 and 15 will be silent. If desired, a separate decoder (not shown) may be connected to the input channels 11 and 12 for detecting this condition and applying the signal to a fourth channel. The fourth channel may be used for any desired control or special sound effects.

Returning again to the drawing, details are shown of circuitry for controlling the FETs 59 and 64 to simultaneously attenuate signals to the left and right output channels 13 and 14 and for controlling the FET 68 to attenuate signals to the center output channel 15. The output 17' of the first amplifier 17 for the left channel is applied through a resistor 75 to the inverting input of an operational amplifier 76. The noninverting input of the amplifier 76 is grounded. The output of the amplifier 76 is applied through a first diode 77 and a feedback resistor 78 to the inverting input of the amplifier 76 and also through the diode 77 to the noninverting input of an operational amplifier 79. The output of the amplifier 76 is further applied through a diode 80 and a resistor 81 to the inverting input of the amplifier 76 and through the diode 80 and a resistor 82 to the negative or inverting input of the amplifier 79. The diodes 77 and 80 are arranged in opposite polarity. When the signal applied through the resistor 75 to the input of the amplifier 76 is positive, the amplifier 76 will have a negative output which causes current to flow through the diode 80 to apply a signal to the inverting input of the amplifier 79. At the same time, the positive input signal to the amplifier 76 will pass through the resistor 78 to the positive input of the amplifier 79. Conversely, when the signal applied through the resistor 75 to the amplifier 76 is negative, an output current will flow through the diode 77 to apply a signal to the noninverting input of the amplifier 79. At the same time, the negative input signal to the amplifier 76 will pass through the resistor 81 to the negative input of the amplifier 79. The amplifier 79 is provided with a negative feedback resistor 83 between its output and its inverting input. The amplifier 79 will have a D.C. output corresponding to a full wave rectification of the signal applied to the left input channel 11. This signal is applied through a resistor 84 to charge a capacitor 85. The voltage across the capacitor 85 will correspond to the average absolute value of the audio signal applied to the left input channel 11. This signal is applied to the noninverting input of an operational amplifier 86. The output of the amplifier 86 is applied through a diode 87 to a junction 88. The junction 88 is connected directly to the inverting input of the amplifier 86 to cause the amplifier 86 to function as a voltage follower. As a consequence, the amplifier 86 will apply a signal to the junction 88 which corresponds to the average absolute value of the audio signal on the left channel 11.

The signal on the right input channel 11 is treated in a similar manner. This signal, as appearing at the output 32' of the amplifier 32, is applied through a resistor 89 to the inverting input of an operational amplifier 90. The noninverting input of the amplifier 90 is grounded. The amplifier 90 has an output applied through a first diode 91 and a feedback resistor 92 to its inverting input and also through the diode 91 to the noninverting input of an operational amplifier 93. The output of the amplifier 90 also is applied through a second diode 94 and a second feedback resistor 95 to its inverting input and through the diode 94 and a resistor 96 to the inverting input of the amplifier 93. As a consequence, when the right channel signal is positive, current flows through the diode 94 and the resistor 96 to apply a signal to the inverting input of the amplifier 93 and, when the input signal is negative, current flows from the amplifier 90 through the diode 91 to apply a signal to the noninverting input of the amplifier 93. The amplifier 93 is provided with a negative feedback resistor 97. The output of the amplifier 93 is connected through a resistor 98 to charge a capacitor 99. The diodes 91 and 94 and the amplifier 93 form a full wave detector so that the capacitor 99 is charged to a voltage which corresponds to the average absolute value of the signal applied to the right input channel 12. The capacitor 99 applies a signal to the noninverting input of an operational amplifier 100. The output of the amplifier 100 is connected through a diode 101 to the junction 88 and the junction 88 is connected directly to the inverting input of the amplifier 100 to form a feedback path. The junction 88 also is connected through a resistor 102 to a terminal 103 which is maintained at a negative voltage with respect to ground.

The two amplifiers 86 and 100 generally function as voltage followers. However, feedback for these amplifiers is determined by the voltage on the junction 88. If the average signal appearing on the right channel, for example, is greater than the signal on the left channel then the amplifier 100 will operate as a voltage follower to apply a voltage to the junction 88 which corresponds to the average absolute value of the signal on the right channel. Since this signal is greater than the signal on the left channel and the junction 88 is connected to apply a feedback signal for the amplifier 86, the diode 87 is back biased and the amplifier 86 will not affect the voltage on the junction 88. Similarly, the diode 101 will be back biased and the amplifier 100 will not affect the voltage on the junction 88, which will be controlled by the amplifier 86, when the average absolute value of the average signal on the left channel 11 is greater than the absolute value of the average signal on the right channel 12. The signal on the junction 88 is applied through a resistor 104 to the inverting input of an operational amplifier 105. The inverting input of the amplifier 105 also is connected through a bias resistor 106 to a terminal 107 which is maintained at a positive voltage with respect to ground. The amplifier 105 has an output applied to a junction 108. A diode 109 is provided in the feedback path for the amplifier 105. The diode 109 is biased so as to conduct only when the output of the amplifier 105 is negative and exceeds the forward voltage of the diode 109. By properly selecting the characteristics of the diode 109, the amplifier 105 will apply a signal to the junction 108 which is the logarithm of the signal on the junction 88. The signal applied by the amplifier 105 to the junction 108 will have a predetermined ratio to the signal on the junction 88, for example, 55 db/volt.

The input signals applied to the left and right input channels 11 and 12 also are processed to obtain a signal which corresponds to the average absolute value of the difference between the left and right input signals. The signal on the left channel, as taken at the output 17' of the amplifier 17, is applied through a resistor 112 to the inverting input of an operational amplifier 113 and also is applied through a resistor 114 to the noninverting input of an operational amplifier 115. Similarly, the signal applied to the right input channel 12, as taken at the output 32' from the amplifier 32, is applied through a resistor 116 to the noninverting input of the amplifier 113 and is applied through a resistor 117 to the inverting of the amplifier 115. The amplifiers 113 and 115 operate as differential amplifiers generating output signals corresponding to the difference between the signals on the left and right input channels 11 and 12. The output of the amplifier 113 is applied through a diode 118 to a junction 119 and thence through a negative feedback resistor 120 to the inverting input of the amplifier 113. Similarly, the output of the amplifier 115 is applied through a diode 121 to the junction 119 and thence through a negative feedback resistor 122 to the inverting input of the amplifier 115. Finally, a resistor 123 is connected from the noninverting input of the amplifier 113 to ground and a resistor 124 is connected from the noninverting input of the amplifier 115 to ground. Due to the polarity of the diode 118, the amplifier 113 will apply a signal on the junction 119 which is equal to the absolute value of the signal on the right input channel minus the signal on the left input channel whenever the signal on the right input channel is more positive. An output from the amplifier 115 corresponding to the absolute value of the signal on the left input channel minus the signal on the right input channel is applied through the diode 121 to the junction 119 whenever the signal on the left input channel is more positive. Thus, a signal will appear on the junction 119 which is either of the outputs from the amplifiers 113 and 115 or is the absolute value of the difference between the signals applied to the left input channel 11 and the right input channel 12.

The junction 119 is connected through a resistor 125 and a capacitor 126 to ground. The resistor 125 and capacitor 126 form an RC time constant with the capacitor 126 being charged to the average voltage appearing on the junction 119, or the average of the absolute value of the instantaneous differences between the signals on the the left and right channels. The voltage on the capacitor 126 is applied to the noninverting input of an operational amplifier 127 which is operated as a voltage follower. The output of the amplifier 127 is applied through a resistor 128 to the inverting input of an operational amplifier 129. The inverting input of the amplifier 129 also is connected through a bias resistor 130 to the positive terminal 107 and the noninverting input of the amplifier 129 is connected to ground. The amplifier 29 applies an output to a junction 131 which is connected through a diode 132 to the inverting input of the amplifier 129. The amplifier 129 is identical to the amplifier 105 and the diode 132 is identical to the diode 109 so that the amplifier 129 will apply an output to the junction 131 which is a logarithm of its input or the logarithm of the average absolute value of the differences between the signals on the left and right input channels.

The signals applied to the junction 131 are shown in the column of the Truth Table headed "|L-R|". It will be readily apparent that when the signals on the left and right inputs 11 and 12 are equal and in phase, their difference applied to the junction 131 will be zero. Also, it will be apparent that when either of the inputs is maximum or equal to one and the other input is minimum or equal to zero, their difference will be one. When both inputs are equal in amplitude but different in nature, the amplifiers 113 and 115 will generate outputs corresponding to the instantaneous difference in the signals. These outputs from the amplifiers 113 and 115 will charge the capacitor 126 so that a signal will appear on the junction 131 similar to the signal on the junction 131 when the inputs differ in amplitude. In the final situation, the left and right inputs 11 and 12 are identical in amplitude and frequency but exactly 180° out of phase. As a consequence, the signals will be summed by the amplifiers 113 and 115 so that the voltage applied to the junction 131 will correspond to twice the signals applied to the inputs 11 and 12.

Attenuation of the signals applied to the left and right output channels 13 and 14 and to the center output channel 15 are controlled in response to the absolute value of the difference of the signals appearing on the junctions 108 and 131. The junction 108 is connected through a resistor 136 to the inverting input of an operational amplifier 137 and through a resistor 138 to the noninverting input of an amplifier 139. The noninverting input of the amplifier 139 also is connected through a resistor 140 to ground. The junction 131 is connected through a resistor 141 to the inverting input of the amplifier 139 and through a resistor 142 to the noninverting input of the amplifier 137. The noninverting input of the amplifier 137 also is connected through a resistor 143 to ground. The amplifier 137 has an output applied through a diode 144 to a junction 145 and the amplifier 139 has an output applied through a diode 146 to the junction 145. The junction 145 is connected through a resistor 147 to the negative terminal 103, through a negative feedback resistor 148 to the inverting input of the amplifier 137 and through a negative feedback resistor 149 to the inverting input of the amplifier 139. The amplifiers 137 and 139 are operated as differential amplifiers which compare the signals on the junctions 108 and 131. When the signal on the junction 108 is more negative than the signal on the junction 131, the amplifier 137 will apply an output through the diode 144 to the junction 145 which is proportional to this difference. Similarly, when the signal on the junction 131 is more negative than the signal on the junction 108, the amplifier 139 will apply a signal through the diode 146 to the junction 145 which is proportional to this difference. As a consequence, the signal on the junction 145 corresponds to the absolute value of the difference between the logarithm of the average absolute value of the greatest of the signals on the left and right input channels 11 and 12 as appears on the junction 108 and the logarithm of the average of the absolute value of the difference of the signals, as appears on the junction 131. The signal on the junction 145 is illustrated in the fourth column of the Truth Table.

The junction 145 is connected through a resistor 152 to the inverting input of an operational amplifier 153. A bias voltage also is applied to the inverting input of the amplifier 153 through a network including a resistor 154 connected from the inverting input of the amplifier 153 to the center tap of a potentiometer 155. The potentiometer 155 has end terminals 156 and 157 which are connected to the positive and negative terminals of a suitable D.C. power supply (not shown). By adjustment of the center tap on the potentiometer 155, the bias voltage on the inverting input of the amplifier 153 is adjusted. The noninverting input of the amplifier 153 is grounded. A feedback network including a series variable resistor 158 and a fixed resistor 159 and a parallel capacitor 160 are connected between the output and the inverting input of the amplifier 153. The output of the amplifier 153 is applied through a resistor 161 to the inverting input of an amplifier 162. The amplifier 162 is provided with a grounded noninverting input and a negative feedback resistor 163. The output of the amplifier 162 is applied through a resistor 164 to the inverting input of an amplifier 165. A bias voltage is applied to the inverting input of the amplifier 165 by a network including a resistor 166 and a potentiometer 167 having end terminals 168 and 169 connected to the positive and negative terminals of a suitable D.C. voltage source (not shown). The amplifier 165 is provided with a grounded noninverting input and with a feedback network including a parallel capacitor 170, resistor 171 and diode 172. The output of the amplifier 165 is applied directly to the junction 70 which controls conduction of the FET 68 for attenuating signals in the center channel. It will be noted that the three amplifiers 153, 162 and 165 each invert their input signal so that the signal applied to the junction 70 is an inversion of the signal on the junction 145.

The output of the amplifier 153 also is applied through a resistor 173 to the inverting input of an operational amplifier 174. The inverting input of the amplifier 174 also is biased with a network including a resistor 175 and a potentiometer 176 having terminals 177 and 178 which are connected to the positive and negative terminals of a D.C. voltage source (not shown). The noninverting input of the amplifier 174 is grounded and a feedback network comprising a parallel capacitor 179, resistor 180 and diode 181 are provided between the output and the inverting input of the amplifier 174. The output of the amplifier 174 is applied directly to the junction 60 for controlling conduction of the FETs 59 and 64 to control attenuation in the left and right channels. It will be noted that the signal applied from the junction 145 through the two amplifier stages 153 and 174 is inverted twice so that the signal on the junction 60 is the same as the signal on the junction 145 and is an inversion of the signal on the junction 70. As a consequence, either the FETs 59 and 64 for the left and right channels or the FET 68 for the center channel will be biased into attenuation at any given time.

It may be desirable to provide some attenuation in each of the three channels when no signal is present on either of the input channels 11 or 12. Providing some attenuation in all of the output channels 13, 14 and 15 under this condition will help eliminate noise so that the sound system will be completely silent when no signal is present. By adjustment of the potentiometer 167 to control the bias voltage on the inverting input of the amplifier 165, the attenuation level for signals passed to the center output channel 15 when no signal is present on the input channels 11 and 12 is established. Similarly, the attenuation level in the left and right channels when no signal is present on the input channels 11 and 12 is established by adjustment of the potentiometer 176 which biases the amplifier 174.

When the apparatus 10 goes from a condition where no signal is present on the input channels 11 and 12 to a condition where a signal is applied to one or both of the input channels 11 and 12, there may be a problem with the circuit initially determining whether the output is monaural or stereophonic. It has been found to be most pleasing to the listener to have the output initially appear as a monaural signal rather than as a stereophonic signal. This is accomplished by selecting the resistors 106 and 130 so that the resistor 106 provides more bias to the amplifier 105 than the resistor 130 provides to the amplifier 129. As a consequence, the signals on the junctions 108 and 131 will differ when no signal is present on the left and right input channels 11 and 12 so that the apparatus 10 will function as if it is in a monaural mode.

It will be appreciated that various changes, modifications and additions may be made to the above-described preferred embodiment of apparatus 10 for separating two audio signals of varying amplitudes appearing on two input channels into output audio signals on at least three output channels without departing from the spirit and the scope of the following claims.

What we claim is:

1. Apparatus for separating two audio signals of varying amplitudes appearing on two input channels into output audio signals on at least three output channels comprising first amplifier means for applying the signal on a first of said input channels to a first of said output channels, second amplifier means for applying the signal on the second input channel to a second of said output channels, third amplifier means for applying the sum of the signals on said first and second input channels to a third output channel, means for attenuating the signals to said third output channel when the signal on said first input channel is appreciably larger in amplitude than the signal on said second input channel, means for attenuating the signals to said third output channel when the signal on said second input channel is appreciably larger in amplitude than the signal on said first input channel, means for attenuating the signals to said first and second output channels when the signals on said first and second input channels are substantially identical in amplitude, frequency and phase, means for generating a first control signal having an amplitude responsive to the average absolute value of the highest amplitude audio signal on said first and second input channels, means for generating a second control signal having an amplitude responsive to the average absolute value of the difference between the audio signals on said first and second input channels, differential amplifier means for generating a third control signal having an amplitude responsive to the absolute value of the difference between said first and second control signals, and wherein said means for attenuating signals to said first, second and third output channels are responsive to said third control signal.

2. Apparatus for separating two audio signals of varying amplitudes appearing on two input channels into output audio signals on at least three output channels, as set forth in claim 1, and further including means responsive to said third control signal for attenuating the signals to said first and second output channels when the signals on said first and second input channels are substantially identical in amplitude and frequency and electrically 180° out of phase.

3. Apparatus for separating two audio signals of varying amplitudes appearing on two input channels into output audio signals on at least three output channels, as set forth in claims 1 or 2, and further including means responsive to said third control signal for attenuating the signals to said third output channel when the signals on said first and second input channels are substantially equal in amplitude and of different frequencies.

* * * * *